United States Patent [19]

Takada et al.

[11] 4,344,898

[45] Aug. 17, 1982

[54] CARBURETOR CONTROLLING SYSTEM

[75] Inventors: Shigetaka Takada, Obu; Yoji Satoh, Nagoya, both of Japan

[73] Assignee: Aisan Kogyo Kabushiki Kaisha, Obu, Japan

[21] Appl. No.: 329,588

[22] Filed: Dec. 10, 1981

[51] Int. Cl.[3] ..... F02M 1/12

[52] U.S. Cl. ..... 261/39 E; 261/DIG. 74; 261/52

[58] Field of Search ..... 261/39 E, 52, DIG. 74

[56] References Cited

U.S. PATENT DOCUMENTS

| | | | |
|---|---|---|---|
| 3,818,881 | 6/1974 | Hosho et al. | 261/39 E |
| 3,948,240 | 4/1976 | Hirosawa et al. | 261/39 E |
| 4,181,107 | 1/1980 | Nomura et al. | 261/39 E |
| 4,321,902 | 3/1982 | Stoltman | 261/52 |

FOREIGN PATENT DOCUMENTS

| | | | |
|---|---|---|---|
| 52-31232 | 3/1977 | Japan | 261/39 E |
| 52-76531 | 6/1977 | Japan | 261/39 E |
| 54-145820 | 11/1979 | Japan | 261/52 |

*Primary Examiner*—Tim R. Miles

*Attorney, Agent, or Firm*—Dennison, Meserole, Pollack & Scheiner

[57] ABSTRACT

In a carburetor system having an electrically-heated choke system including a first heat generating member which is heated by the power supplied from a battery and a first thermo-sensitive member which is deformed by the heating operation of the first heat generating member and adapted for controlling an opening and closing operation of a choke valve by the deformation of the first thermo-sensitive member, and a fast idle system adapted for controlling an opening and closing operation of a throttle valve, the inventive carburetor controlling system comprises a second heat generating member which is heated by the power supplied from the battery, a second thermo-sensitive member which is deformed by the heating operation of the second heat generating member and controls an opening and closing operation of the throttle valve, a control circuit connected between the battery and the first and second heat generating members, a thermosensor for detecting an atmospheric temperature. The control circuit comprises a comparator circuit for comparing a compared input voltage corresponding to an output of the thermosensor with a predetermined reference voltage and a power circuit for controlling an amount of power supplied from the battery to the first and second heat generating members in accordance with the compared output of the comparator circuit.

2 Claims, 7 Drawing Figures

CARBURETOR CONTROLLING SYSTEM

BACKGROUND OF THE INVENTION

This invention generally relates to a carburetor controlling system having an electrically-heated choke system which converts power supplied from a battery into a mechanical energy and controls an opening and closing operation of a choke valve by the mechanical energy and having a fast idle system which controls an opening and closing operation of a throttle valve, and more particularly to a carburetor controlling system further including a means provided in the fast idle system for converting an electrical energy from the battery and a control circuit provided among the battery, the electrically-heated choke system and the fast idle system for controlling power supply to both the systems in response to the detected atmospheric temperature so as to individually and properly perform the opening and closing operations of the choke valve and the throttle valve.

A conventional carburetor system for an internal combustion engine in an automobile is typically provided with an electrically-heated choke system having a heat generating member such as Nichome wire which is heated by the power supplied from a battery mounted in the automobile and a thermo-sensitive member such as a bimetal which is physically deformed by heat from the heat generating member for controlling the opening and closing operation of a choke valve by the physical deformation of the thermo-sensitive member, and with a fast idle system for controlling the opening and closing operation of a throttle valve in an idling-up operation to accelerate the warm-up of a cold engine.

Heretofore, it has been imposed to minimize fuel consumption in an automobile. A method of solving the problem of fuel consumption is proposed to open a choke valve as early as possible.

However, in a conventional carburetor controlling system, the electrically-heated choke system is designed in such a manner that electrical power is directly supplied from the battery through an ignition key switch to the choke system, and the fast idle system is connected through a power transmitting means such as a lever and a cam to the electrically-heated choke system. Accordingly, even if the structure of the electrically-heated choke valve is modified so as to open the choke valve as early as possible, it is difficult to fully attain the required characteristics of the choke valve opening degree which are different at normal temperature and at low temperature. Furthermore, the fast idle system is apt to erroneously operate at early opening operation of the choke valve. In the worst case, the throttle valve opens undesirably early thereby causing a malfunction of an engine. For the abovementioned reasons, it has been considered difficult to thoroughly solve the problem of fuel consumption.

SUMMARY OF THE INVENTION

Accordingly, it is an object of the present invention to provide a carburetor controlling system which solve the afore-mentioned problems associated with the early opening operation of the choke valve to satisfactorily improve fuel consumption.

It is another object of the present invention to provide a carburetor controlling system which includes a fast idle system and an electrically-heated choke system for individually performing a given service and also includes a control circuit by which electric power is supplied to the fast idle system and the electrically-heated choke system in response to atmospheric temperature.

In a carburetor system having an electrically-heated choke system including a first heat generating member which is heated by the power supplied from a battery and a first thermo-sensitive member which is deformed by the heating operation of the first heat generating member and adapted for controlling an opening and closing operation of a choke valve by the deformation of the first thermo-sensitive member, and a fast idle system adapted for controlling an opening and closing operation of a throttle valve, the inventive carburetor controlling system comprises a second heat generating member which is heated by the power supplied from the battery, a second thermo-sensitive member which is deformed by the heating operation of the second heat generating member and controls the opening and closing operation of the throttle valve, a control circuit connected between the battery and the first and second heat generating members, and a thermosensor for detecting an atmospheric temperature. The control circuit comprises a comparator circuit for comparing a compared input voltage corresponding to an output of the thermosensor with a predetermined reference voltage and a power circuit for controlling the amount of power supplied from the battery to the first and second heat generating members in accordance with the compared output of the comparator circuit.

Various general and specific objects, advantages and aspects of the invention will become apparent when reference is made to the following detailed description of the invention considered in conjunction with the related accompanying drawings.

DETAILED DESCRIPTION OF THE PREFERRED EMBODIMENT

Figure 1:
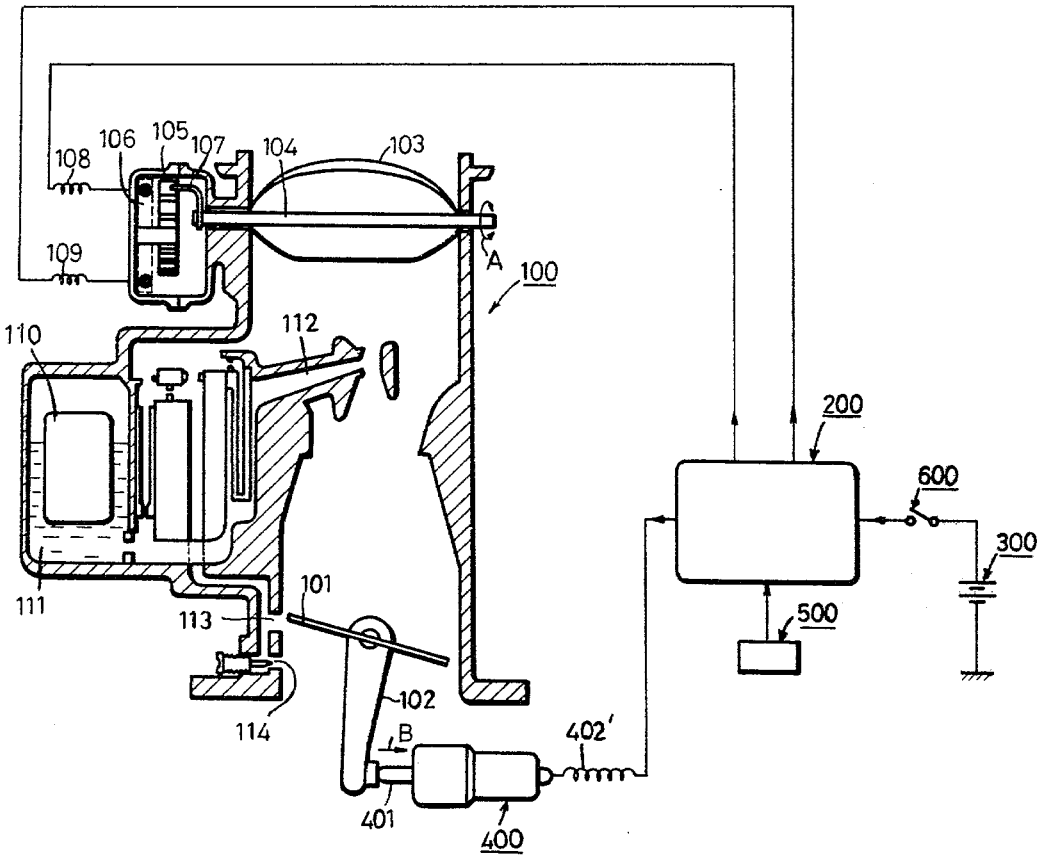
FIG. 1 is a general illustration of the carburetor controlling system according to the present invention.

Referring now to FIG. 1, a carburetor controlling system is generally provided with a carburetor 100, a control circuit 200, a battery 300 mounted in an automobile (not shown) and grounded to the automotive body, an actuator 400 of a fast idle system, a thermosensor 500 for detecting an atmospheric temperature and a key switch 600. The carburetor is provided with a throttle valve 101 for controlling the amount of discharged fuel by its opening and closing operation and a lever 102 connected to the throttle valve 101 and effective to be rotated by the axial movement of a shaft 401 of the actuator 400. A choke valve 103 is adapted for restricting induction air to the carburetor 100 by its opening and closing operation. A shaft 104 is engaged with the choke valve 103 and effective to rotate in the direction of an arrow A as depicted in FIG. 1. An electrically-heated choke system of this embodiment is provided with a first thermo-sensitive member 105 such as a coil-like bimetal, a first heat generating member 106 such as a Nichrome wire resistor, a ceramic resistor or a PTC heater, and a power transmitting means 107 for transmitting the driving force created by the physical deformation of the first thermo-sensitive member 105 to the shaft 104. Leads 108 and 109 are adapted to supply the electric power supplied from the control circuit 200 to the first heat generating member 106. The carburetor 100 is typically provided with a float 110, liquid fuel 111 such as gasoline, a main nozzle 112, a slow port 113 and an idle port 114. The actuator 400 is provided with a lead 402' connected to the control circuit 200 and effective to transmit the output from the control circuit 200 to the actuator 400.

Figure 2:
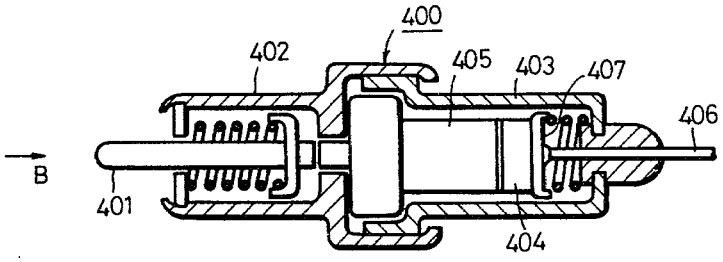
FIG. 2 is an enlarged transverse sectional view of the actuator of the system shown in FIG. 1.

Referring next to FIG. 2 which shows the inside structure of the actuator 400, a first housing case 402 is engaged with a second housing case 403 which encloses a second heat generating member 404 such as a Nichrome wire resistor, a ceramic resistor, or a PTC heater and a second thermo-sensitive member 405 such as a bimetal or a wax type of displacement member. A terminal 406 is connected to the lead 402' at its one end as shown in FIG. 1 and to an electrode 407 which is attached to the second heat generating member 404 at its other end.

When the key switch 600 is turned on so as to start an engine, the control circuit 200 serves to reduce the electric power supplied from the battery 300 to the power level corresponding to the output detected by the thermosensor 500. The lower-level power is supplied through the leads 108 and 109 to the first heat generating member 106 of the electrically-heated choke system as well as supplied through the lead 402', the terminal 406 and the electrode 407 to the second heat generating member 404 of the fast idle system.

Upon receiving the low-level power, the first heat generating member 106 starts to generate heat and the first thermo-sensitive member 105 provided adjacent to the first heat generating member 106 is physically deformed by the thermal energy, thereby causing the choke valve 105 which is in closed position before the engine start to begin the opening operation.

The second heat generating member 104 creates heat upon reception of the low-level power, and the second thermo-sensitive member 405 provided adjacent to the second heat generating member 404 is shrunk in the axial direction of the shaft 401 by the thermal energy, thereby causing the shaft 401 connected to the second thermo-sensitive member 405 to start an axial motion in the direction of an arrow B as shown in FIGS. 1 and 2. As the result of this axial motion, the throttle valve 101, which is in the opened position corresponding to an atmospheric temperature before the engine start, initiates the closing operation.

Figure 7:
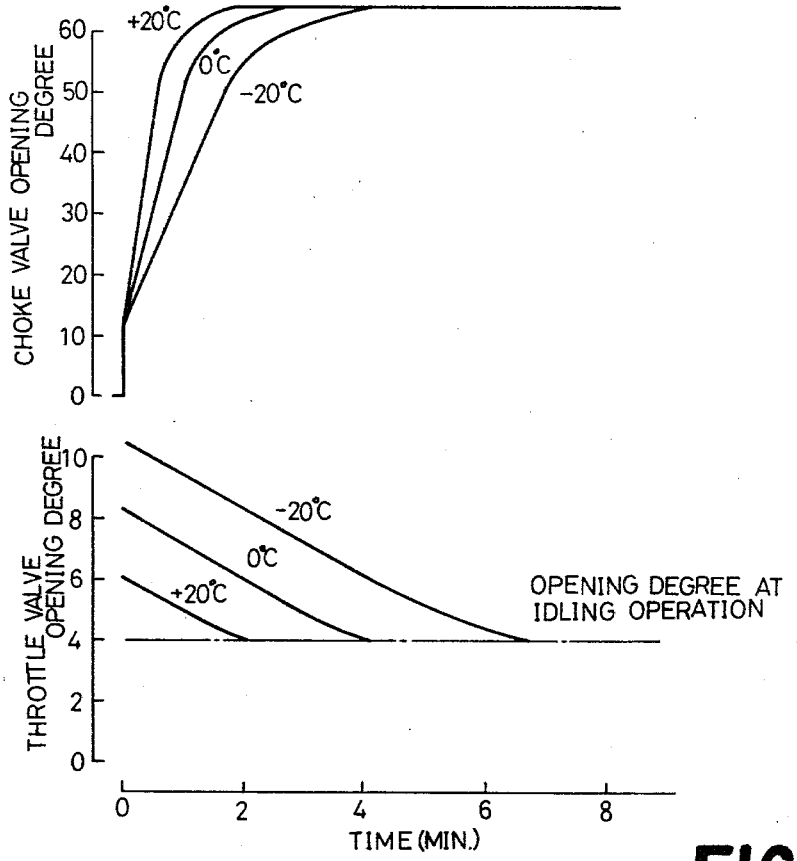
FIG. 7 is a graph depicting, by way of illustration, valve opening degree curves obtainable from embodiments employing teachings of the invention.

The opening degree of the throttle valve before the engine start is predetermined so that the proper amount of fuel may be supplied to the engine corresponding to an atmospheric temperature as shown in FIG. 7. The initial predetermination primarily depends on the deformation condition of the second thermo-sensitive member 405 corresponding to the atmospheric temperature before the engine start.

After starting the engine by turning on the key switch 600 followed by the supply of electric power to the electrically-heated choke system and the fast idle system, the vacuum created by the engine operation causes the fuel 111 to be supplied from the slow port 113 and the idle port 114 to the engine.

Figure 3:
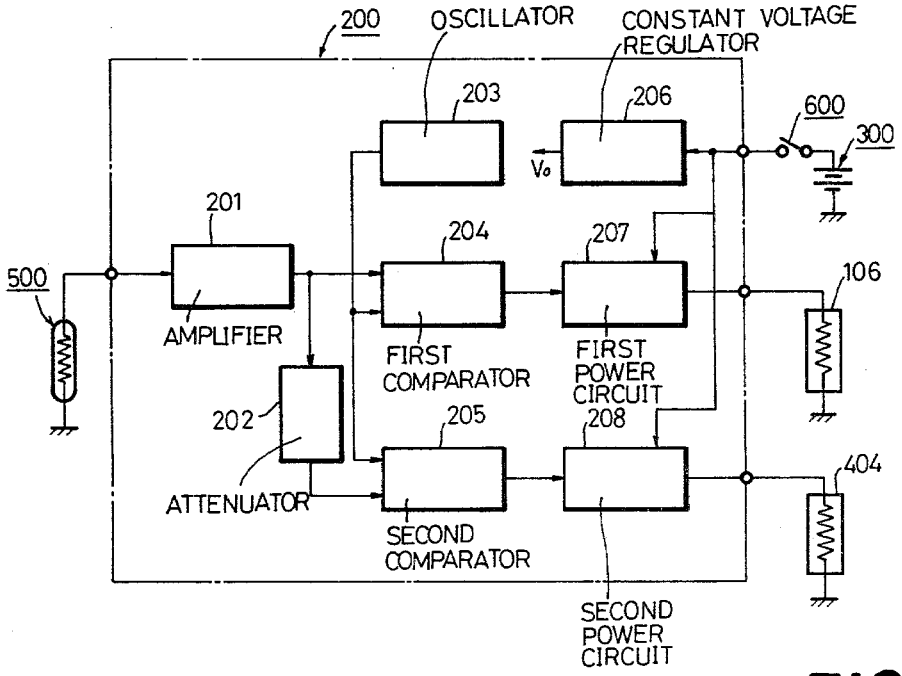
FIG. 3 is a schematic block diagram of the control circuit of the system shown in FIG. 1.

Referring to FIG. 3, the control circuit 200 includes an amplifier 201, an attenuator 202, a triangle wave oscillator 203, a first comparator 204, a second comparator 205, a constant voltage regulator circuit 206, a first power circuit 207, and a second power circuit 208.

Figure 5:
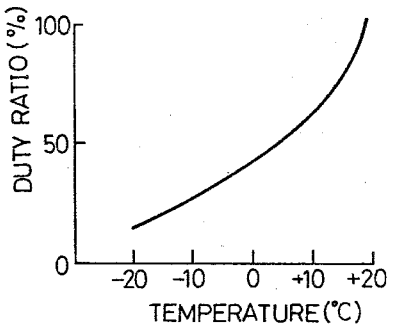
FIGS. 5 and 6 are graphs illustrating duty ratio-atmospheric temperature characteristics obtainable with a choke system and a fast idle system, respectively.
Figure 6:
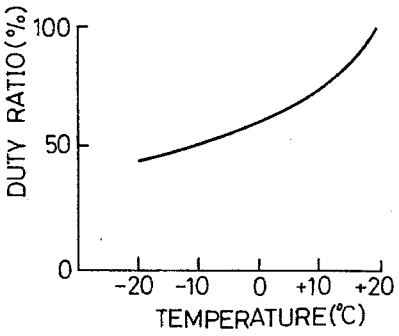

The thermosensor 500 is, for example, a thermistor of which the resistance is decreased with an increase in the atmospheric temperature. Output from the thermosensor 500 is supplied to the amplifier 201 and the amplified output is supplied to one input terminal of the first comparator 204. At the same time, the amplified output is supplied through the attenuator 202 to one input terminal of the second comparator 205. The amplified output from the amplifier 201 and the reference output from the triangle wave oscillator 203 are compared by the first comparator 204 thereby causing the duty ratio of the output from the first comparator 204 to be changed. Similarly, the attenuated output from the attenuator 202 and the reference output are compared by the second comparator 205, thereby causing the duty ratio of the output from the second comparator 205 to be changed. The first power circuit 207 is controlled by the on and off outputs from the first comparator 204 corresponding to the change of the duty ratio as shown in FIG. 5 and the amount of electric power supplied from the battery 300 to the first heat generating member 106 is determined. Similarly, the second power circuit 208 is controlled by the on and off outputs from the second comparator 205 corresponding to the change of the duty ratio as shown in FIG. 6 and the amount of electric power supplied from the battery 300 to the second heat generating member 404 is determined. The constant voltage regulator circuit 206 outputs the reference voltage $V_0$ which is in turn applied to the amplifier 201 and the oscillator 203.

Figure 4:
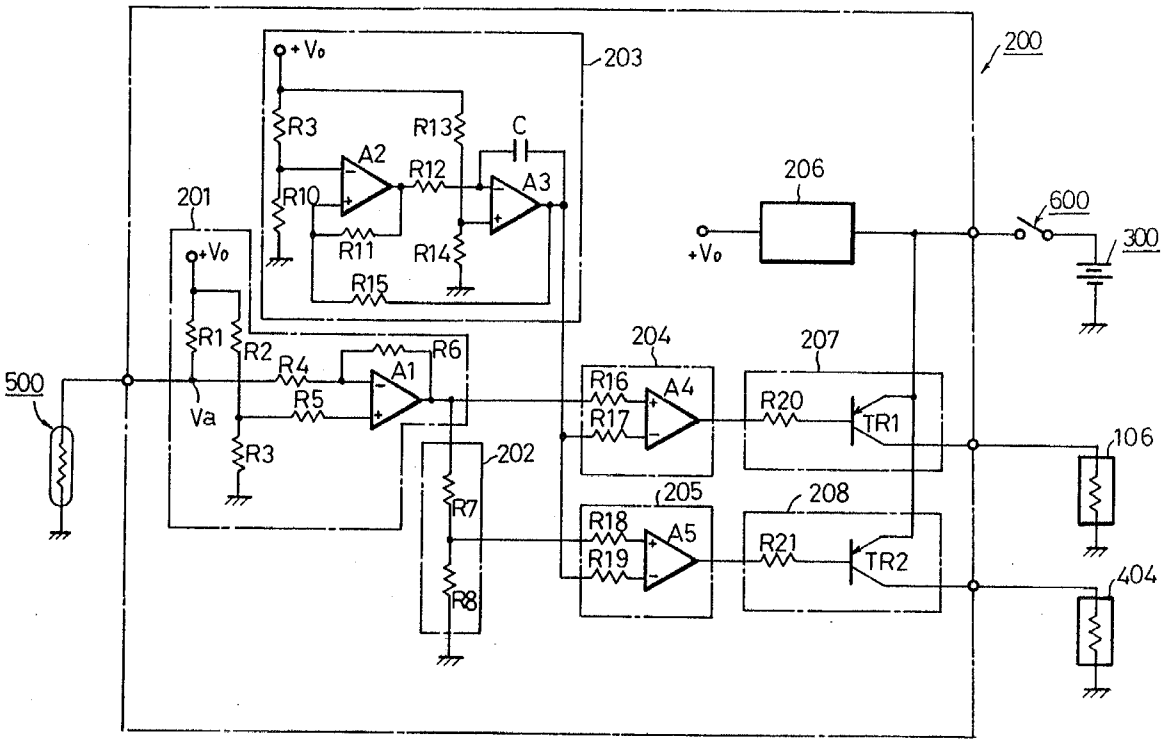
FIG. 4 is an electric circuit diagram of the control circuit of the system shown in FIG. 1.

Referring to FIG. 4, the electric circuit of the control circuit 200 includes operational amplifiers A1 and A5, switching transistors TR1 and TR2, resistances R1 and R2 and a capacitor C. The same reference numbers as in FIG. 3 indicate the same elements.

In operation of the control circuit 200 under the conditions of low atmospheric temperature, for example, when the key switch 600 is turned on, the predetermined reference voltage $V_0$ is outputted from the constant voltage regulator circuit 206 and supplied to the amplifier 201 and the triangle wave oscillator 203.

The output from the constant voltage regulator circuit 206 is supplied through the resistance R1 of the amplifier 201 to the thermistor 500, thereby causing high voltage due to the high resistance of the thermistor 500, that is, thermistor high output voltage corresponding to low atmospheric temperature to be created at the output terminal of the thermistor 500. The thermistor high output voltage is inputted through the resistance R4 to the inverting input terminal of the operational amplifier A1, while the divided voltage of the reference voltage $V_0$ is inputted through the resistances R2, R3 and R5 to the non-inverting input terminal. Both the thermistor high output voltage and the divided voltage are amplified by the operational amplifier A1 and then a low-level amplified voltage is outputted from the operational amplifier A1. The low-level amplified voltage is inputted through the resistance R16 of the first comparator 204 to the non-inverting input terminal of the operational amplifier A4 and on the other hand, it is divided by the resistances R7 and R8 of the attenuator 202 to be converted to a low-level divided voltage and then supplied through the resistance R18 of the second comparator 205 to the non-inverting input terminal of the operational amplifier A5. The oscillator 203 to which the reference voltage $V_0$ is applied creates a predetermined reference signal, for example, a triangle wave reference voltage signal which is in turn inputted through the respective resistances R17 and R19 of the first and secnd comparators 204 and 205 to the inverting input terminals of the operational amplifiers A4 and A5.

The low-level amplified voltage and the triangle reference voltage signal are amplified by the operational amplifier A4 of the first comparator 204. The switching transistor TR1 performs a switching operation wherein the ratio of on and off periods (duty ratio) is small, depending upon a controlled voltage of the transistor TR1, thereby causing a low-level electric power to be supplied to the first heat generating member 106. Similarly, the low-level divided voltage and the triangle wave reference voltage signal are amplified by the operational amplifier A5 of the second comparator 205. The switching transistor TR2 performs a switching operation wherein the duty ratio is small, thereby causing a low-level electric power to be supplied to the second heat generating member 404.

As the atmospheric temperature increases during the running of engine, resistance of the thermistor 500 decreases, whereby the output voltage of the thermistor 500 also progressively decreases.

For this reason, the output voltage of the amplifier 201 increases from the low-level amplified voltage at low atmospheric temperature, and the divided voltage of the attenuator 202 also increases. The switching transistors TR1 and TR2 perform switching operations wherein the duty ratio tends to increase as shown in FIGS. 5 and 6, thereby causing the electrical power supplied to the first heat generating member 106 and the second heat generating member 404 to be increased.

As a result, the duty ratios of both the switching transistors TR1 and TR2 increase with an increase in an atmospheric temperature, and the characteristics of the duty ratios of the switching transistors TR1 and TR2 are respectively indicated in FIGS. 5 and 6.

As shown in FIG. 7, opening degree characteristics of a choke valve and a throttle valve are obtainable by employing the control circuit under suitable conditions as shown in FIG. 4.

Although only one preferred embodiment of the invention has been disclosed and described, it is apparent that other embodiments and modifications of the invention are possible within the scope of the appended claims.

What is claimed is:

1. In combination with a carburetor system having an electrically-heated choke system including a first heat generating member which is heated by the power supplied from a battery and a first thermo-sensitive member which is deformed by the heating operation of said first heat generating member and adapted for controlling an opening and closing operation of a choke valve by the deformation of said first thermo-sensitive member, and a fast idle system adapted for controlling an opening and closing operation of a throttle valve, a carburetor controlling system comprising a second heat generating member which is heated by the power supplied from said battery, a second thermo-sensitive member which is deformed by the heating operation of said second heat generating member and controls an opening and closing operation of said throttle valve, a control circuit connected between said battery and said first and second heat generating members, a thermosensor for detecting an atmospheric temperature, said control circuit comprising a comparator circuit for comparing a compared input voltage corresponding to an output of said thermosensor with a predetermined reference voltage and a power circuit for controlling an amount of power supplied from said battery to said first and second heat generating members in accordance with the compared output of said comparator circuit.

2. The carburetor controlling system as defined in claim 1 wherein said compared input voltage is divided into a first compared input voltage and a second compared input voltage by a voltage dividing circuit provided at the input of said comparator circuit; said comparator circuit comprising a first comparator circuit to which is inputted said first compared input voltage and a second comparator circuit to which is inputted said second compared input voltage; and said power circuit comprising a first power circuit for determining the level of power supplied to said first heat generating member in accordance with a first compared output from said first comparator circuit and a second power circuit for determining the level of power supplied to said second heat generating member in accordance with a second compared output from said second comparator circuit.

* * * * *